US011076243B2

(12) United States Patent
Jung et al.

(10) Patent No.: US 11,076,243 B2
(45) Date of Patent: Jul. 27, 2021

(54) TERMINAL WITH HEARING AID SETTING, AND SETTING METHOD FOR HEARING AID

(71) Applicant: SAMSUNG ELECTRO-MECHANICS CO., LTD., Suwon-si (KR)

(72) Inventors: Dae Kwon Jung, Suwon-si (KR); Yun Tae Lee, Suwon-si (KR); Sung Youl Choi, Suwon-si (KR); Bang Chul Ko, Suwon-si (KR); Ho Kwon Yoon, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/854,961

(22) Filed: Apr. 22, 2020

(65) Prior Publication Data

US 2020/0404431 A1 Dec. 24, 2020

(30) Foreign Application Priority Data

Jun. 20, 2019 (KR) ..... 10-2019-0073393
Sep. 30, 2019 (KR) ..... 10-2019-0121005

(51) Int. Cl.
*H04R 25/00* (2006.01)

(52) U.S. Cl.
CPC ..... *H04R 25/505* (2013.01); *H04R 25/554* (2013.01); *H04R 2225/41* (2013.01); *H04R 2225/43* (2013.01)

(58) Field of Classification Search
CPC ..... H04R 25/505; H04R 25/554; H04R 2225/43; H04R 2225/41; H04R 25/55; H04R 25/507; H04R 25/558; H04R 2225/55; G10L 25/51; G10L 25/30
See application file for complete search history.

(56) References Cited

U.S. PATENT DOCUMENTS

2008/0159548 A1* 7/2008 Solum ..... H04R 25/552 381/58
2010/0254540 A1* 10/2010 Bang ..... H04R 25/70 381/60
2012/0190305 A1* 7/2012 Wuidart ..... H04Q 9/00 455/41.3
2013/0266164 A1* 10/2013 Woods ..... H04R 25/70 381/314
2013/0343584 A1* 12/2013 Bennett ..... H04R 25/554 381/315

FOREIGN PATENT DOCUMENTS

KR 10-2005-0119758 A 12/2005
KR 10-2013-0118513 A 10/2013
KR 10-2017-0062362 A 6/2017
KR 10-2018-0125385 A 11/2018

* cited by examiner

*Primary Examiner* — Tuan D Nguyen
(74) *Attorney, Agent, or Firm* — NSIP Law

(57) ABSTRACT

A terminal may include: a sensor unit including a microphone configured to acquire a surrounding sound and a position sensor configured to detect a position of the terminal; a processor configured to identify characteristics of a voice of a specific person designated by a user of the terminal through learning, and determine a setting value determining operating characteristics of a hearing aid based on the characteristics of the voice of the specific person; and a communicator configured to transmit the setting value to the hearing aid.

19 Claims, 4 Drawing Sheets

TERMINAL WITH HEARING AID SETTING, AND SETTING METHOD FOR HEARING AID

CROSS-REFERENCE TO RELATED APPLICATIONS

This application claims the benefit under 35 U.S.C. § 119(a) of Korean Patent Application Nos. 10-2019-0073393 and 10-2019-0121005 filed on Jun. 20, 2019 and Sep. 30, 2019, respectively, in the Korean Intellectual Property Office, the entire disclosures of which are incorporated herein by reference for all purposes.

BACKGROUND

1. Field

The following description relates to a mobile terminal with hearing aid setting, and a setting method of a hearing aid.

2. Description of Related Art

A hearing aid is a device configured to amplify or modify sound in a wavelength band that people of normal hearing ability can hear, and to enable the hearing impaired to hear sound at the same level as people of normal hearing ability. In the past, a hearing aid simply amplified external sounds. However, recently, a digital hearing aid capable of delivering cleaner sound for use in various environments has been developed.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a terminal includes: a sensor unit including a microphone configured to acquire a surrounding sound and a position sensor configured to detect a position of the terminal; a processor configured to identify characteristics of a voice of a specific person designated by a user of the terminal through learning, and determine a setting value determining operating characteristics of a hearing aid based on the characteristics of the voice of the specific person; and a communicator configured to transmit the setting value to the hearing aid.

The processor may be further configured to obtain a voice of a call counterpart and learn the voice of the call counterpart to identify the characteristic of the voice of the specific person, in response to a call being made with a number of a contact stored in the terminal.

The processor may be further configured to perform learning on a voice input through the microphone to identify the characteristic of the voice of the specific person, in response to the position of the terminal being determined to be a place where the user of the terminal frequently stays.

The processor may be further configured to receive a voice input through the hearing aid through the communicator and learn the voice input through the hearing aid to identify the characteristic of the voice of the specific person, in response to the position of the terminal being determined to be a place where the user of the terminal frequently stays.

The processor may be further configured to identify the characteristic of the voice of the specific person by using a pre-stored voice file.

The processor may be further configured to determine the setting value such that the voice of the specific person is amplified more than other sounds.

The processor may be further configured to identify a surrounding environment of the user of the terminal, based on the surrounding noise and the position of the terminal, and identify, through learning, characteristics of the surrounding noise according to the surrounding environment.

The processor may be further configured to determine the setting value such that the surrounding noise is removed.

The terminal may be a mobile terminal.

The processor may include a neural processing unit.

In another general aspect, a method with hearing aid setting includes: identifying, by a terminal, characteristics of a voice of a specific person designated by a user of the terminal through learning; determining, by the terminal, a setting value for determining operating characteristics of a hearing aid based on the characteristics of the voice of the specific person; and transmitting, by the terminal, the setting value to the hearing aid.

The identifying of the characteristics of the voice of the specific person may include acquiring a voice of a call counterpart and learning the voice of the call counterpart to identify the characteristic of the voice of the specific person, in response to a call being made with a number of a contact stored in the terminal.

The identifying of the characteristics of the voice of the specific person may include performing learning on a voice input through a microphone to identify the characteristic of the voice of the specific person, in response to a position of the terminal being determined to be a place where the user of the terminal frequently stays.

The identifying of the characteristics of the voice of the specific person may include receiving a voice input through the hearing aid and performing learning to identify the characteristic of the voice of the specific person, in response to the position of the terminal being determined to be a place where the user of the terminal frequently stays.

The identifying of the characteristics of the voice of the specific person may include identifying the characteristic of the voice of the specific person by using a pre-stored voice file.

The determining of the setting value may include determining the setting value such that the voice of the specific person is amplified more than other sounds.

The method may further include: identifying a surrounding environment of the user of the terminal based on a surrounding noise and a position of the terminal, and identifying characteristics of the surrounding noise according to the surrounding environment through learning; and determining the setting value such that the surrounding noise is removed.

The terminal may be a mobile terminal.

In another general aspect, a non-transitory computer-readable storage medium stores instructions that, when executed by a processor, cause the processor to perform the method described above.

Other features and aspects will be apparent from the following detailed description, the drawings, and the claims.

Figure 1:
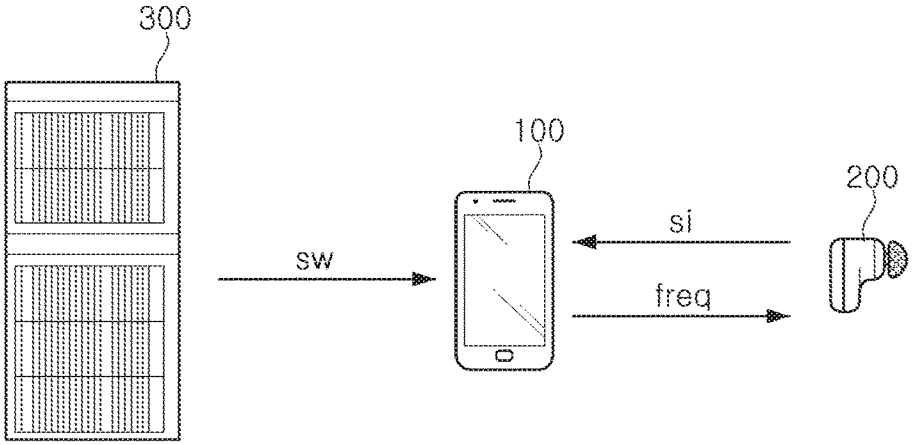
FIG. 1 is a view schematically illustrating a system for performing a setting method for a hearing aid, according to an embodiment.

Throughout the drawings and the detailed description, the same drawing reference numerals refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after an understanding of the disclosure of this application may be omitted for increased clarity and conciseness.

The features described herein may be embodied in different forms and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a view schematically illustrating a system for performing a setting method of a hearing aid, according to an embodiment. Referring to FIG. 1, the system may include a terminal 100, a hearing aid 200, and a server 300. The terminal 100 is, for example, a mobile terminal, and will be referred to as a mobile terminal hereinafter as a non-limiting example.

The mobile terminal 100 may output, to the hearing aid 200, a setting value (freq) for determining a frequency characteristic, or the like, of the hearing aid 200. The mobile terminal 100 may output the setting value (freq) based on a voice signal detected by the mobile terminal 100, information on surrounding conditions detected by the mobile terminal 100, a voice signal (si) received from the hearing aid 200, and the like. An operation of the mobile terminal 100 may be performed by executing at least one or more applications. In addition, the mobile terminal 100 may download the at least one or more applications from the server 300.

The hearing aid 200 may amplify and output sound introduced from an outside environment. In this case, operating characteristics (e.g., a gain for each frequency band among audible frequency bands, or the like) of the hearing aid 200 may be determined by the setting value (freq).

The server 300 may store one or more applications to perform an operation described below, and may transmit at least one or more applications (sw) according to a request of the mobile terminal 100 to the mobile terminal 100.

Figure 2:
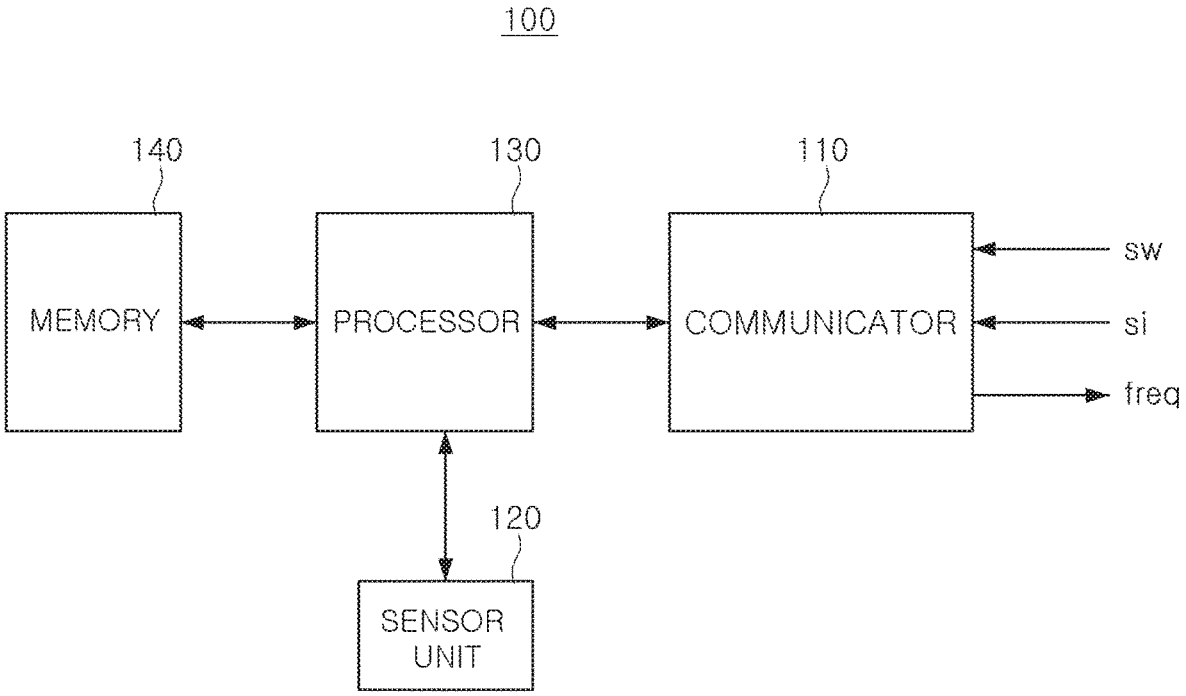
FIG. 2 is a block diagram schematically illustrating a configuration of a mobile terminal, according to an embodiment.

FIG. 2 is a block diagram schematically illustrating a configuration of the mobile terminal 100, according to an embodiment. Referring to FIG. 2, the mobile terminal may include a communicator 110, a sensor unit 120, a processor 130, and a memory 140.

The communicator 110 may include a plurality of communication modules for transmitting and receiving data in different methods. The communicator 110 may download the one or more applications (sw) from the sever 300 (see, FIG. 1). In addition, the communicator 110 may receive, from the hearing aid 200 (see, FIG. 1), the information (si) on a voice signal collected by the hearing aid 200 of. In addition, the communicator 110 may transmit the setting value (freq) of the hearing aid to the hearing aid 200 (see, FIG. 1). As described above, the setting value (freq) of the hearing aid is a value for determining operating characteristics of the hearing aid, and may be, for example, a gain value for each frequency band among audible frequency bands. Alternatively, the setting value (freq) of the hearing aid may be information on a specific frequency of voice signals.

The sensor unit 120 may include, for example, a microphone for acquiring surrounding sounds, a position sensor for detecting a position of a mobile terminal, and various sensors for sensing surrounding environments. The position sensor may include a global positioning system (GPS) receiver, or the like. The position sensor may, for example, detect a position of the mobile terminal using a position of an access point (AP) connected through a Wi-Fi communication network, a connected bluetooth device, or the like. Alternatively, the position sensor may determine a position of the mobile terminal by using a personal schedule stored in the mobile terminal.

The processor 130 controls an overall operation of the mobile terminal 100. The processor 130 may store the application received from the server in the memory 140, and may load and execute the application stored in the memory 140 as needed.

The processor 130 may determine user's surrounding environments (for example, the user's position or current situation), based on a voice signal input through the microphone of the sensor unit 120 and a position of the mobile terminal input from the position sensor of the sensor unit 120, and may identify the characteristics of the surrounding noise according to the user's surrounding environment through learning. The characteristic of the ambient noise may be a frequency band of surrounding noise. That is, the processor 130 may identify the frequency band of the surrounding noise corresponding to the user's surrounding environments through learning. For example, the processor 130 may identify a frequency band of the surrounding noise that occurs frequently while the user stays at home, a frequency band of the ambient noise that occurs frequently when the user commutes to work, and the like.

In addition, the processor 130 may identify characteristics (e.g., a frequency band) of a user's voice and a specific person's voice designated by the user through learning. For example, when a call is made with a number of a contact frequently used in a mobile terminal or a number of a contact stored in the mobile terminal, a voice of a call counterpart may be obtained and learned to identify characteristics of a specific person's voice. Alternatively, based on the voice signal collected at a place where the user frequently stays, learning may be performed on the voice that is frequently input at the corresponding place to identify the characteristic of the specific person's voice. In this case, a voice may be input through a microphone of the mobile terminal, of a voice input to the hearing aid (200 of FIG. 1) may be received through the communicator 110 of the mobile terminal. Alternatively, by executing a specific application through the mobile terminal, it is possible to obtain the specific person's voice, and identify the characteristics of the specific person's voice by learning the voice. Alternatively, characteristics of a specific person's voice may be obtained through explicit recording during a voice call, a pre-stored voice file can be used, or a voice signal input to a Bluetooth device (for example, AI speaker) connected to a mobile terminal can be acquired as the specific person's voice.

In addition, the processor 130 may determine the setting value of the hearing aid based on the learned characteristics of the user's voice, the characteristic of the specific person's voice, and the characteristics of the surrounding noise according to the surrounding environments. For example, the processor 130 may determine a setting value of the hearing aid so that the specific person's voice is amplified more than other sounds. The processor 130 may determine a setting value of the hearing aid so that there is no ringing phenomenon for the user's voice. The processor 130 may determine a setting value of the hearing aid so that appropriate surrounding noise is removed according to the user's surrounding environment. The setting value of the hearing aid may be a gain value according to a frequency.

The processor 130 may include an application and a neural processing unit (NPU).

The processor 130 may perform the above-described operation through a deep learning operation. The deep learning operation, a branch of a machine learning process, may be an artificial intelligence technology that allows machines to learn by themselves and infer conclusions without teaching conditions by human. According to an embodiment of this disclosure, it is possible to set the hearing aid more effectively by using the deep learning operation to determine the setting value of the hearing aid. In addition, according to an embodiment, the deep learning may be performed using the NPU mounted on the mobile terminal 100 (for example, a smartphone).

The memory 140 may store at least one or more applications. In addition, the memory 140 may store various data that is a basis for learning that the processor 130 performs.

Figure 3:
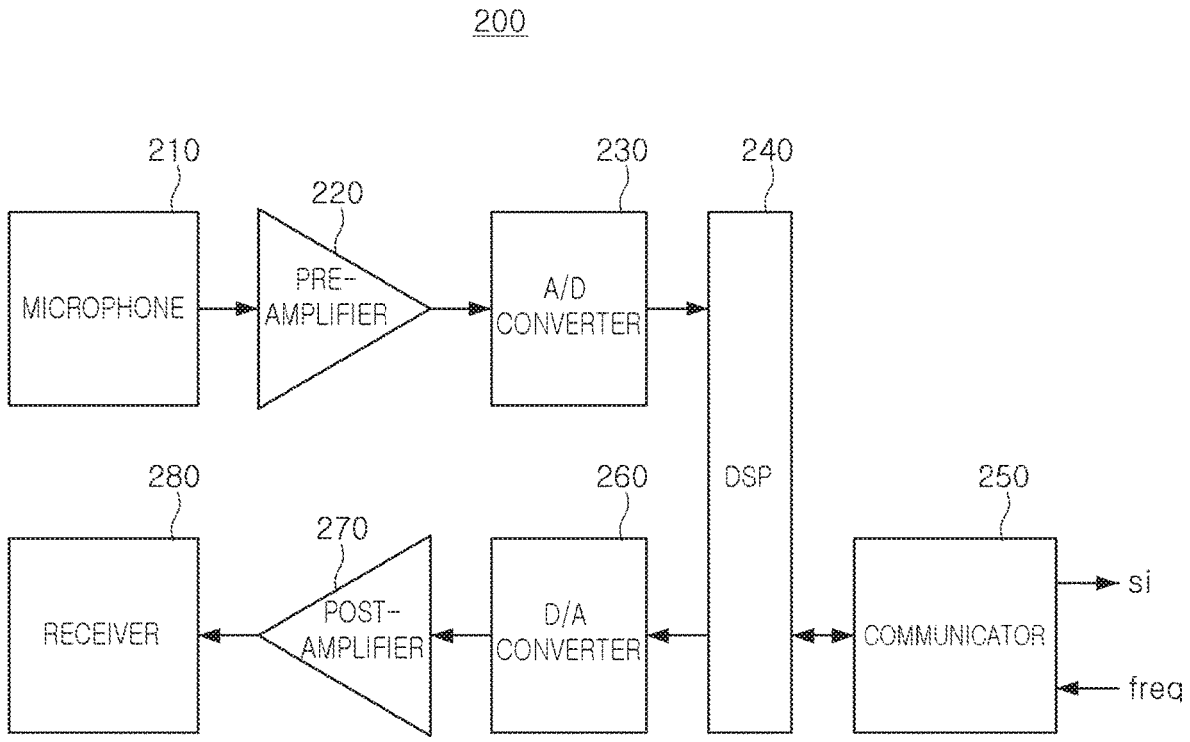
FIG. 3 is a block diagram schematically illustrating a configuration of a hearing aid, according to an embodiment.

FIG. 3 is a block diagram schematically illustrating a configuration of the hearing aid 200, according to an embodiment. The hearing aid 200 may include a microphone 210, a pre-amplifier 220, an analog to digital (A/D) converter 230, a digital signal processor (DSP) 240, a communicator 250, a digital to analog (D/A) converter 260, a post-amplifier 270, and a receiver 280.

The microphone 210 may receive an external analog sound signal (for example, voice, or the like) and transmit the signal to the pre-amplifier 220.

The pre-amplifier 220 may amplify the analog sound signal transferred from the microphone 210 to a predetermined level.

The A/D converter 230 may receive the amplified analog sound signal output from the pre-amplifier 220 and convert the amplified analog sound signal into a digital sound signal.

The DSP 240 may receive the digital sound signal from the A/D converter 230, process the digital sound signal using a signal processing algorithm, and output the processed digital sound signal to the D/A converter 260. Operating characteristics of the signal processing algorithm may be adjusted by a setting value (freq). For example, a gain value may be set or changed for each frequency band in the signal processing algorithm by the setting value (freq).

The communicator 250 may receive the setting value (freq) from the mobile terminal 100 (see, FIG. 1). In addition, the communicator 250 may transmit the information (si) on the sound input to the hearing aid 200 to the mobile terminal 100.

The D/A converter 260 may convert the received digital signal into an analog signal.

The post amplifier 270 may receive the converted analog signal from the D/A converter 260 and amplify the converted analog signal to a predetermined level.

The receiver 280 may receive the amplified analog signal from the post amplifier 270 and provide the amplified analog signal to a user wearing a hearing aid.

Figure 4:
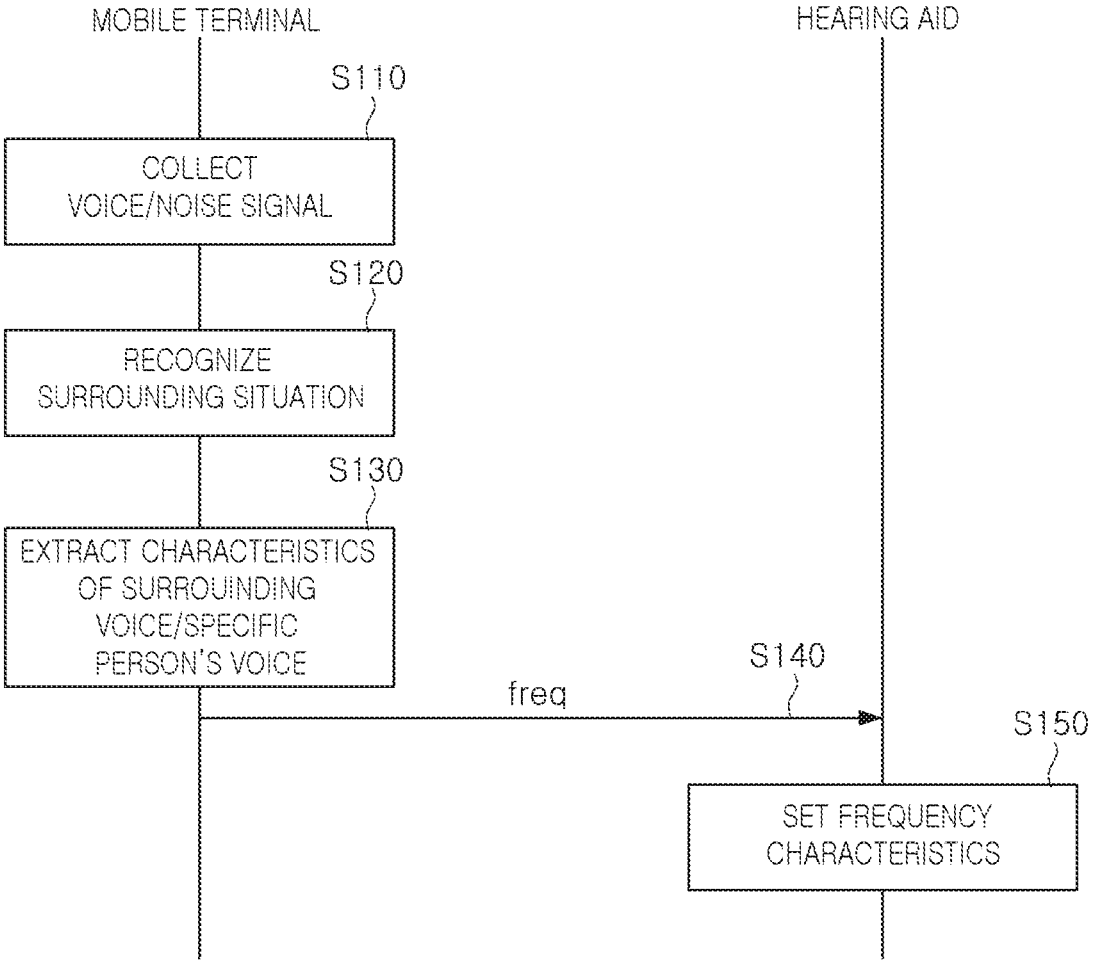
FIGS. 4 and 5 are views for illustrating setting methods of a hearing aid, according to embodiments.

FIG. 4 is a view for explaining a setting method of a hearing aid, according to an embodiment.

First, in operation S110, a mobile terminal, for example, the mobile terminal 100 (e.g., a smartphone), may collect a voice signal and/or a noise signal using a microphone of the mobile terminal.

In operation S120, the mobile terminal may use sensors, for example, sensors in the sensor unit 120, to recognize a surrounding situation of the mobile terminal. The sensors of the mobile terminal may include, for example, a Wi-Fi receiver, a Global Positioning System (GPS) receiver, a Bluetooth device, and the like. For example, the mobile terminal may use the sensors to identify the location of the user of the mobile terminal (e.g., a house or a roadside).

Next, in operation S130, the mobile terminal may identify characteristics of noise according to ambient situations, characteristics of a user's voice, or may identify characteristics of a specific person's voice. The characteristics of the noise, the user's voice, and the specific person's voice may be respective frequency characteristics. In this case, the mobile terminal may perform learning based on the identified ambient situation and the collected noise/voice signal, and use a result of the learning to identify the characteristics.

Further, in operation S130, a setting value of the hearing aid (e.g., the hearing aid 200) may be determined based on the identified characteristics. In this case, the setting value of the hearing aid may be information on a gain for each frequency band and a frequency to be amplified.

Next, in operation S140, the mobile terminal may transmit the determined setting value (freq) of the hearing aid to the hearing aid.

Next, in operation S150, the hearing aid may set a value related to the operation of the hearing aid based on the received setting value (freq) of the hearing aid. For example, the hearing aid may adjust a gain value for each frequency band based on a setting value (freq). In this way, the hearing aid can remove the ambient noise more appropriately according to the user's environment. Alternatively, the hearing aid may transfer a specific person's voice to the user more clearly.

In FIG. 4, each of the operations performed in the mobile terminal 100 (i.e., operations S110 to S140) may be performed by the mobile terminal 100 executing a specific application. The application may be downloaded from the server 300 to the mobile terminal 100.

Figure 5:
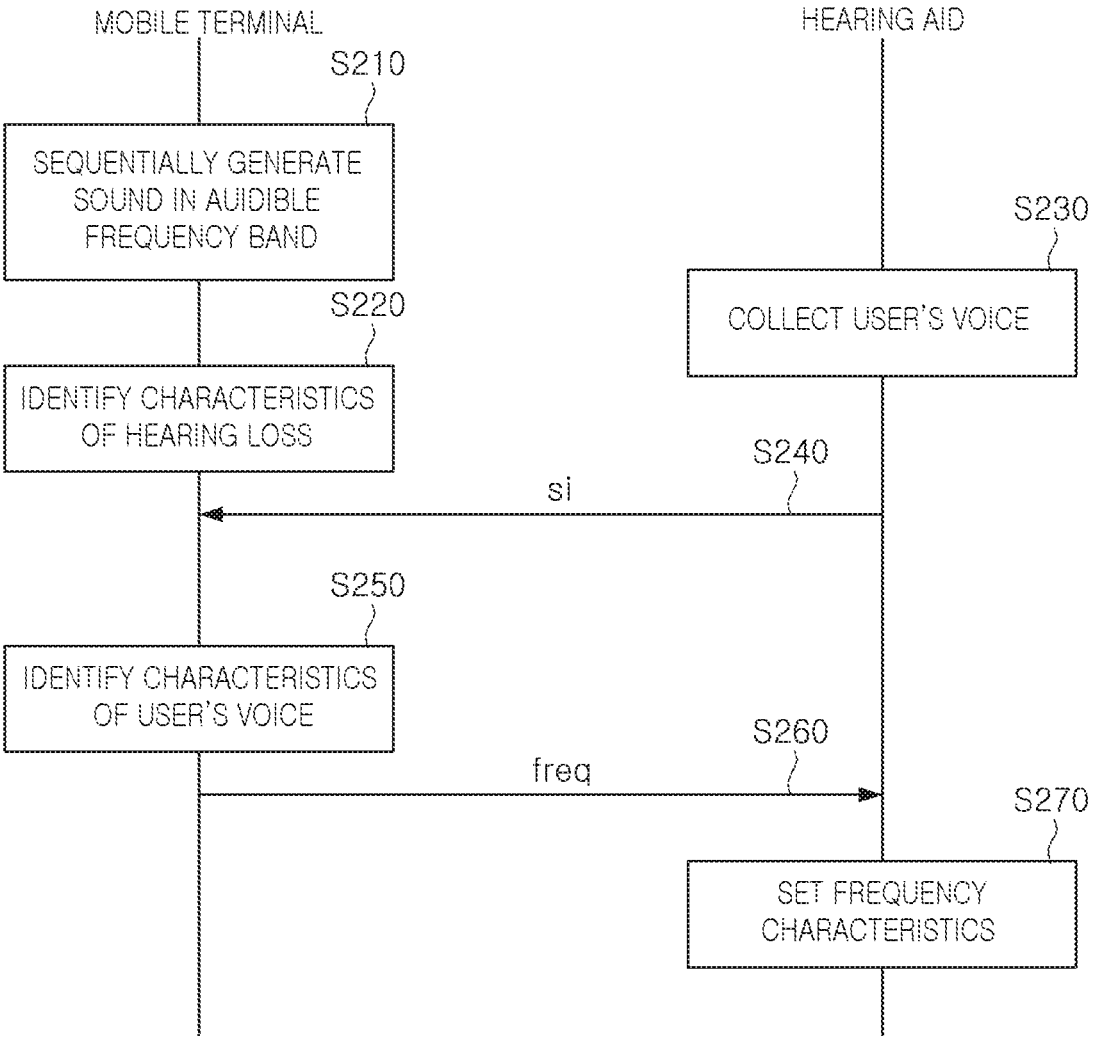

FIG. 5 is a view for explaining a setting method of a hearing aid, according to an embodiment.

First, in operation S210, the mobile terminal (e.g., the mobile terminal 100) may sequentially generate a sound of an audible frequency band.

Next, a user may provide an appropriate feedback to the mobile terminal according to a presence or absence of sound, and the mobile terminal may gather the hearing loss frequency of the user based on a feedback of the user in operation S220. In this example, the mobile terminal may gather a hearing loss frequency of the user through learning.

In the operation S220, a setting value of the hearing aid (e.g., the hearing aid 200) may be determined based on the identified hearing loss frequency of the user. In this case, the setting value of the hearing aid may be information on a gain for each frequency band or a frequency to be amplified.

In addition, the hearing aid may collect the user's voice in operation S230. For example, the hearing aid may collect the voice of the user introduced through the microphone of the hearing aid. Alternatively, the hearing aid may collect voice of other people. For example, when a specific command is received from the mobile terminal, the hearing aid may collect voices introduced through the microphone of the hearing aid at that time.

Next, in operation S240, the hearing aid may transmit information (si) of the user's voice to the mobile terminal. Alternatively, the hearing aid may transmit information on another person's voice to the mobile terminal.

Next, in operation S250, the mobile terminal may identify the characteristics of the user's voice. In this example, the mobile terminal may learn the information (si) of the user's voice received from the hearing aid to identify the characteristics of the user's voice. Alternatively, the mobile terminal may collect the user's voice through the microphone of the mobile terminal, and learn the collected user's voice to identify characteristics of the user's voice. For example, the mobile terminal may collect the user's voice by collecting a user's voice input through the microphone of the mobile terminal, or recording the user's voice through execution of a specific application.

Alternatively, when the location of the mobile terminal is a place where the user frequently stays, the mobile terminal may learn the characteristics of the specific person's voice by learning another person's voice received from the hearing aid.

In operation S250, a setting value of the hearing aid may be determined based on characteristics of the user's voice. In this case, the setting value of the hearing aid may be information on a gain for each frequency band, a frequency to be amplified, or the like.

Next, in operation S260, the mobile terminal may transmit the determined setting value (freq) of the hearing aid to the hearing aid.

Next, in operation S270, the hearing aid may set a value related to the operation of the hearing aid based on the received setting value (freq) of the hearing aid. For example, the hearing aid may adjust a gain value for each frequency band based on a setting value (freq). Thereby, the hearing aid may remove the ambient noise more appropriately according to the user's environment. Alternatively, the hearing aid may transfer the specific person's voice to the user more clearly.

In FIG. 5, each of the operations performed in the mobile terminal (i.e., operations S210, S220, S250, and S260) may be performed by the mobile terminal executing a specific application.

According to embodiments disclosed herein, in a mobile terminal (for example, a smartphone) that supports a deep learning function using a specific application, a frequency that is not naturally heard by the user may be learned and dataized, and stored, and the learned data may be transmitted to the hearing aid. In this case, the learned data may be a frequency spectrum in which hearing loss patients are inaudible, and the hearing aid may set a frequency band and a gain value based on the data in a DSP (e.g., the DSP 240 in FIG. 3.

According to an embodiment disclosed herein, through an application based on artificial intelligence (AI), the sound of the audible frequency band may be sequentially generated to identify which section of the frequency band is inaudible to a user. In addition, frequency bands of a user's voice may be learned to remove a pulsing effect by which the user's voice can hear again through a hearing aid. In this example, the user's voice may be input directly, or may be automatically learned at the time of a recorded voice or phone call. The learned hearing loss frequency band and the voice band of the user can be stored in the smart phone or dataized and stored through a cloud, and the data can be transmitted to the hearing aid to set up a digital signal processor (DSP) in the hearing aid. Therefore, according to an embodiment disclosed herein, when a time to replace a hearing aid arrives, there is an advantage that auditory inspection and hearing aid tuning are unnecessary if the learned data is transmitted to a replacement hearing aid.

As set forth above, according to embodiments disclosed herein, a setting value for determining operating characteristics of a hearing aid may be set more appropriately using a setting method for the hearing aid implemented by a mobile terminal.

The communicator 110, the communicator 250, the sensor unit 120, the processor 130, the memory 140, the server 300, the processor, the receiver 280, the processors, the memories, and other components and devices in FIGS. 1 to 5 that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods illustrated in FIGS. 1 to 5 that perform the operations described in this application are performed by computing hardware, for example, by one or more processors or computers, implemented as described above executing instructions or software to perform the operations described in this application that are performed by the methods. For example, a single operation or two or more operations may be performed by a single processor, or two or more processors, or a processor and a controller. One or more operations may be performed by one or more processors, or a processor and a controller, and one or more other operations may be performed by one or more other processors, or another processor and another controller. One or more processors, or a processor and a controller, may perform a single operation, or two or more operations.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A terminal, comprising:

a sensor unit comprising a microphone configured to acquire a surrounding sound and a position sensor configured to detect a position of the terminal;

a processor configured to identify characteristics of a voice of a specific person designated by a user of the terminal through learning, and determine a setting value determining operating characteristics of a hearing aid based on the characteristics of the voice of the specific person; and a communicator configured to transmit the setting value to the hearing aid.

2. The terminal of claim 1, wherein the processor is further configured to obtain a voice of a call counterpart and learn the voice of the call counterpart to identify the characteristic of the voice of the specific person, in response to a call being made with a number of a contact stored in the terminal.

3. The terminal of claim 1, wherein the processor is further configured to perform learning on a voice input through the microphone to identify the characteristic of the voice of the specific person, in response to the position of the terminal being determined to be a place where the user of the terminal frequently stays.

4. The terminal of claim 1, wherein the processor is further configured to receive a voice input through the hearing aid through the communicator and learn the voice input through the hearing aid to identify the characteristic of the voice of the specific person, in response to the position of the terminal being determined to be a place where the user of the terminal frequently stays.

5. The terminal of claim 1, wherein the processor is further configured to identify the characteristic of the voice of the specific person by using a pre-stored voice file.

6. The terminal of claim 1, wherein the processor is further configured to determine the setting value such that the voice of the specific person is amplified more than other sounds.

7. The terminal of claim 1, wherein the processor is further configured to identify a surrounding environment of the user of the terminal, based on the surrounding noise and the position of the terminal, and identify, through learning, characteristics of the surrounding noise according to the surrounding environment.

8. The terminal of claim 7, wherein the processor is further configured to determine the setting value such that the surrounding noise is removed.

9. The terminal of claim 1, wherein the terminal is a mobile terminal.

10. The terminal of claim 1, wherein the processor comprises a neural processing unit.

11. A method with hearing aid setting, comprising:

identifying, by a terminal, characteristics of a voice of a specific person designated by a user of the terminal through learning;

determining, by the terminal, a setting value for determining operating characteristics of a hearing aid based on the characteristics of the voice of the specific person; and transmitting, by the terminal, the setting value to the hearing aid.

12. The method of claim 11, wherein the identifying of the characteristics of the voice of the specific person comprises acquiring a voice of a call counterpart and learning the voice of the call counterpart to identify the characteristic of the voice of the specific person, in response to a call being made with a number of a contact stored in the terminal.

13. The method of claim 11, wherein the identifying of the characteristics of the voice of the specific person comprises performing learning on a voice input through a microphone to identify the characteristic of the voice of the specific person, in response to a position of the terminal being determined to be a place where the user of the terminal frequently stays.

14. The setting method of the hearing aid of claim 11, wherein the identifying of the characteristics of the voice of the specific person comprises receiving a voice input through the hearing aid and performing learning to identify the characteristic of the voice of the specific person, in response to the position of the terminal being determined to be a place where the user of the terminal frequently stays.

15. The method of claim 11, wherein the identifying of the characteristics of the voice of the specific person comprises identifying the characteristic of the voice of the specific person by using a pre-stored voice file.

16. The method of claim 11, wherein the determining of the setting value comprises determining the setting value such that the voice of the specific person is amplified more than other sounds.

17. The method of claim 11, further comprising:

identifying a surrounding environment of the user of the terminal based on a surrounding noise and a position of the terminal, and identifying characteristics of the surrounding noise according to the surrounding environment through learning; and determining the setting value such that the surrounding noise is removed.

18. The method of claim 11, wherein the terminal is a mobile terminal.

19. A non-transitory computer-readable storage medium storing instructions that, when executed by a processor, cause the processor to perform the method of claim 11.

* * * * *